United States Patent [19]

Hadfield et al.

[11] 4,392,628

[45] Jul. 12, 1983

[54] CONCEALED ACCESS FURNITURE

[76] Inventors: Frederick C. Hadfield, 5225 Hollister, Houston, Tex. 77040; Marvin R. McElroy, 25240 F.M. 2978, Houston, Tex. 77375

[21] Appl. No.: 285,490

[22] Filed: Jul. 21, 1981

[51] Int. Cl.[3] ..... A47B 96/06

[52] U.S. Cl. ..... 248/202.1; 211/95; 211/144

[58] Field of Search ..... 248/202.1, 1; 312/125, 312/135, 305, 252, 11, 197; 211/77, 78, 95, 144

[56] References Cited

U.S. PATENT DOCUMENTS

| | | | |
|---|---|---|---|
| 2,166,633 | 7/1939 | Hardy | 312/305 |
| 2,650,871 | 9/1953 | Holderegger | 312/322 |
| 2,740,684 | 4/1956 | Haralson | 312/305 |
| 3,436,768 | 4/1969 | Dauwalder | 312/322 |
| 3,672,741 | 6/1972 | Clark | 312/252 |

*Primary Examiner*—William H. Schultz
*Assistant Examiner*—Ramon O. Ramirez

[57] ABSTRACT

The disclosure is of a frame member rotatable about a vertical axis, with means in the rotative system for locking the frame member in 180° positions and also for permitting relative movement relative to the rotative means whereby a frame member may be integrated with respect to a stationary wall opening. The rotatable means is a circular race with indentations at 180° positions.

4 Claims, 3 Drawing Figures

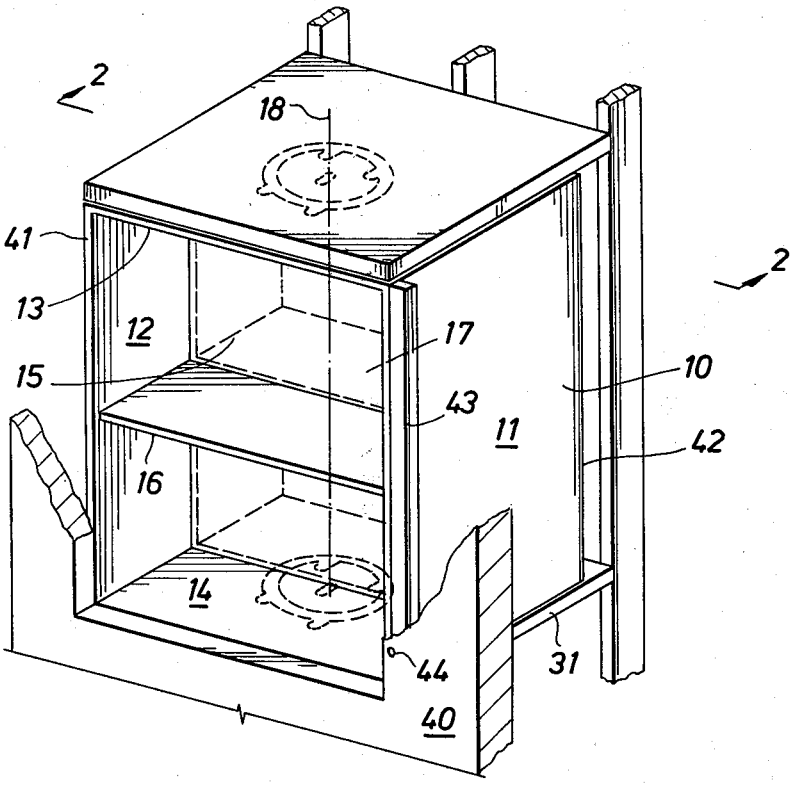
FIG. 1
FIG. 2
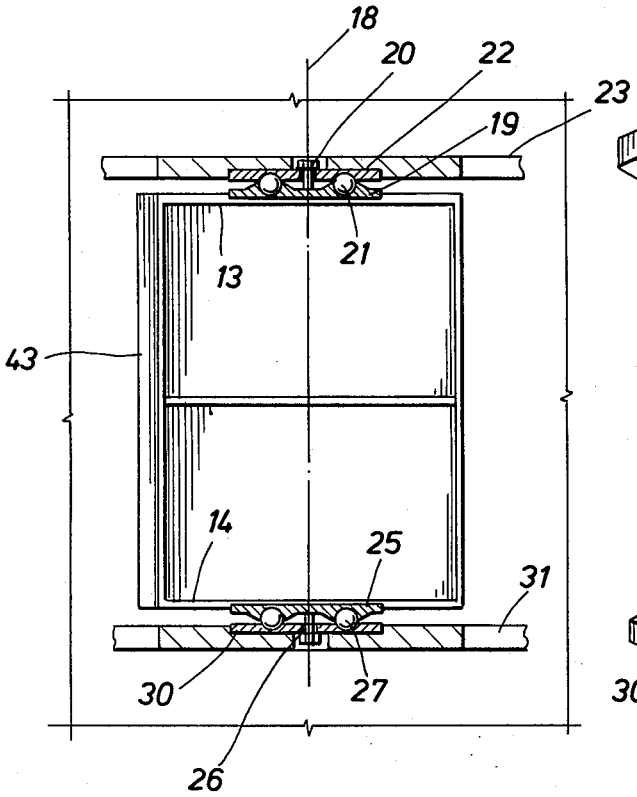
FIG. 3
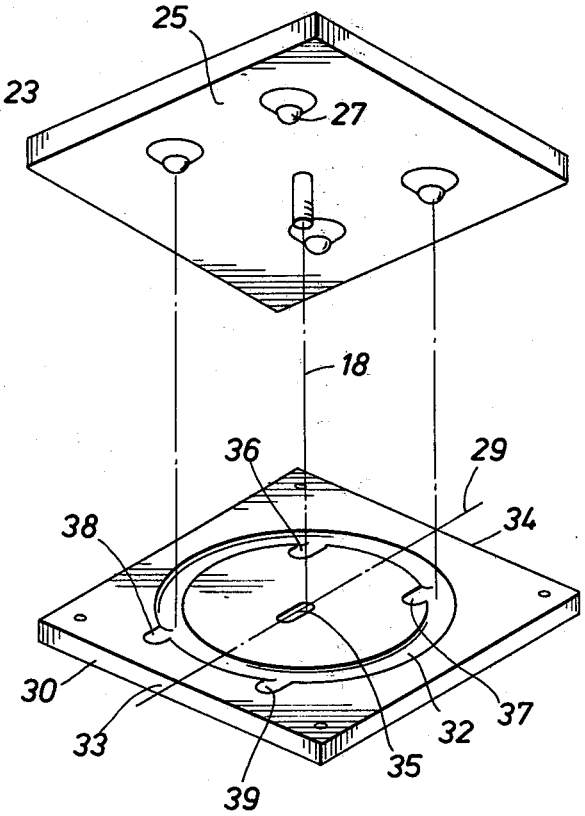

CONCEALED ACCESS FURNITURE

FIELD OF THE INVENTION

The present invention relates to concealed access furniture or cabinets, and more particularly, to a cabinet including a rotatably mounted cabinet frame with a self-alignment feature.

BACKGROUND OF THE INVENTION

Furniture or cabinets with rotatable storage elements are well known. Examples of typical prior art cabinet devices are shown in U.S. Pat. Nos. 1,366,931, 3,436,768 and 2,650,871. The Prior art systems with rotatable elements principally have used gear and other type of positive drive mechanisms for producing the rotation of a storage element. In general, this type of prior art system also involves impractical or complex mechanisms. This is particularly true where concealed cabinet elements are desired because an obvious construction defeats the purpose of having a rotatable storage element.

THE PRESENT INVENTION

The present invention is embodied in a construction which includes a frame member or storage element which is rotatably supported at its top and bottom walls by bearing plates which provide vertical stability for the frame member while permitting rotation about a vertical axis. The bearing plates for the frame member have bearings disposed in a circular track for full 360° rotation of the frame member about the vertical axis of rotation. The vertical axis of rotation and the bearings of the frame member are arranged with respect to offset recesses in the circular track at 180° positions to provide for a locking function of the bearings relative to the track and so that the frame member can be brought into close fitting contact with an outer wall surface thereby integrating the frame member with respect to the outer wall surface. In addition, if desired, a locking mechanism can be provided so that the frame member may be locked in either rotational position with respect to the outer wall surface.

DESCRIPTION OF THE DRAWINGS

In the drawings;

FIG. 1 illustrates in perspective view, an embodiment of the present invention wherein the frame member is rotatably supportive with respect to an outer wall surface;

FIG. 2 is a view in cross section taken along line 2—2 of FIG. 1;

FIG. 3 is a view in perspective of the alignment of a set of bearing plates.

DESCRIPTION OF THE PREFERRED EMBODIMENT

Referring now to the drawings, in FIG. 1 a frame member 10 is illustrated as a rectangular and elongated box-like structure with side walls 11, 12 and upper and lower end walls 13 and 14. Intermediate of the width of the side walls 11 and 12 is a vertical dividing wall 15. The vertical dividing wall 15 separates the depth of the frame member into a forward space, which is illustrated, and a rearward space, which is not seen from the front. The forward space, for illustration purposes, has an intermediate shelf 16 and the rearward space has an intermediate shelf 17 (shown in dashed line). It will be appreciated that the forward space of the frame member 10 can be utilized to contain equipment such as vending equipment or the like for commercial operations, or can be utilized as a bookshelf for home application, and so forth. The rearward space can be designed to accomodate any sort of storage or utility that may be desired and can function as a concealed space.

The frame member 10 has a vertical axis of rotation 18 which extends through the center point of the upper and lower walls 13 and 14. Attached to the upper wall 13 is a rectangular plate member 19 which has an upstanding central post member 20 aligned with the vertical axis 18. Four bearing members 21 are disposed on the plate member 19 at equal distances from one another and at equal distances from the center post 20. Effectively, the bearings are located at a common radius distance with respect to the center post. The center post 20 extends upwardly through a central elongated opening in an upper bearing plate member 22. The upper bearing plate 22 is, in turn, attached to an upper horizontal structural wall or support member 23.

The lower end wall 14 of the frame member is similarly attached to a rectangular shaped bearing plate 25 where the bearing plate has a downwardly extending central post 26 aligned with the vertical axis 18 and has spaced apart bearings 27. The bearings 27, plate member 25 and post 26 are identical to the arrangement of the upper plate member 19, but reversed in position with respect to the upper plate member 19. The post member 26 extends through a central elongated opening in a lower bearing plate member 30. The bearing plate member 30 is attached to a permanent lower horizontal structural wall or support member 31. Support members 23 and 31 are attached to a vertical wall member 40.

The upper plate member 22 and the lower plate member 30 are similar in construction so that a description of one will suffice for the other. Referring now to FIG. 3, the lower plate member 30, has a annular, semi-cylindrically shaped race or indentation 32 which receives the bearings 27 for 360° rotation about the vertical axis 18. The plate member 30 has a forward and rearward surfaces 33 and 34 and transverse horizontal axis 29 which bisects an elongated central opening 35. Equi-distantly spaced to either side of the longitudinal axis 29 are similarly shaped indentations 36, 37, 38 and 39 which are offset from race 32 and aligned parallel to the horizontal axis 35. The indentations 36–39 are spaced from one another with dimensions comparable to the spacing of the bearings 27 so that when the bearings 27 are aligned with the indentations 36–39 the cabinet frame member 10 as a whole may be moved, relative to the base plates 22 and 30 toward the forward surface 33 of a plate member. The bearings 27, when recieved in the indentations 36–39, thereby lock the frame member in position against rotation. In addition, the length of the indentations 36–39 with respect to the positioning of the plates and a forward edge surface 41 on the frame member which is defined by a vertical plane is such that the forward edge surfaces 41 of the frame member engage the inner wall or wall member surface of a furniture or building wall 40 in a matching and engaging relationship.

From the foregoing description, and as illustrated in FIGS. 1–3, it will be appreciated that in FIG. 1 the frame member is shown in one rotatable position where the bearings are within the indentations 36–39 and the forward vertical edge surface 41 of the frame member 10 is in engagement with the inner surface of the exterior wall 40. By moving the frame member 10 rearwardly, the ball members 27 are moved from the indentations 36–39 into the circular race 32 and the forward edge surface 41 is moved away from the wall surface 40 whereupon the frame member 10 can be rotated through 180 degrees to bring the rear edge surface 42 of the frame member into position facing the vertical wall 40. The frame member 10 when then pulled forward will bring the ball members 27 once again within the indentations 36–39 to flush mount the frame member 10 to the wall 40.

The frame member 10 may be provided with a side lip 43 on opposite, diagonally opposed corners of the unit to cooperate with a lock member 44 in the wall 40. The lock member 44 is diagramatically illustrated and may be any one of a number of conventional lock devices which can be either concealed or an open type which latches to the flange member 43. Thus, the unit can be safely locked in position in either position of orientation with respect to the rotative axis. This construction thereby permits relatively safe construction for maintaining the security of the unit.

We claim:

1. A system for mounting a rotatable frame member with respect to a vertical wall member comprising:

an elongated, rectangularly shaped frame member having vertical side walls and horizontal top and bottom walls where the side edges of said walls define at least one forward edge surface lying in a vertical plane, a vertical axis extending through said top and bottom walls and being parallel to the vertical plane defined by said forward edge surface, a forward vertical wall member, upper and lower horizontal support members attached to said forward vertical wall member, first plate members respectively attached to said upper support member and said top wall of said frame member, and second plate members respectively attached to said lower support member and said bottom wall of said frame members, rotational means on each of said plate members aligned with respect to said vertical axis for permitting rotation of said frame member for at least 180° about said vertical axis while providing vertical stability for said frame member, said rotational means having means for locking said plate members relative to one another at 180° positions, said locking means being operative upon horizontal movement of said plate members on said frame member relative to the plate members on said support members.

2. The system as defined in claim 1 wherein the sets of plate members disposed between a support member and a wall respectively have bearings and a circular race, said circular race having offset indentations at 180° from one another, said indentations being disposed so as to permit horizontal movement of each of said plate members in a set of plate member relative to one another.

3. A system for mounting a rotatable frame member with respect to a vertical wall member comprising:

an elongated, rectangularly shaped frame member having vertical side walls and horizontal top and bottom walls where the side edges of said walls defining forward and rearward edge surfaces respectively lying in vertical forward and rearward planes, a vertical axis extending through said top and bottom walls and being parallel to the vertical plane defined by said forward and rearward edge surface, a forward vertical wall member, upper and lower horizontal support members attached to said forward vertical wall member, first plate members respectively attached to said upper support member and said top wall of said frame member, second plate members respectively attached to said lower support member and said bottom wall of said frame member, rotational means on each of said first and second plate members aligned with respect to said vertical axis for permitting rotation of said frame member for at least 180° about said vertical axis while providing vertical stability for said frame member, each of said first and second plate members having upper and lower plates where one of said plates has at least four spaced apart bearing members and the other of said plates has a circular race for rotatably receiving said bearing members, and one of said plates has a vertical post and the other plates has an elongated slot for slidably receiving said vertical post, said elongated slot being disposed in a direction transverse to said vertical planes, said circular race having elongated indentations spaced apart relative to the spacing of said bearing members and aligned parallel to said elongated slot whereby one of said plates in each of said first and second plate members may be moved horizontally with respect to the other of said plates in each of said first and plate members thereby to lock said plate members against relative rotation.

4. The system as defined in claim 3 wherein the length of the indentations relative to the spacing of a vertical plane through an edge surface from a vertical wall member permits locking of the plate members while bringing the end surface which lies in said vertical plane flush with a vertical wall surface.

* * * * *